United States Patent [19]

Kenney

[11] 4,384,168

[45] May 17, 1983

[54] CONDUCTOR FOR A FLUID-COOLED WINDING

[75] Inventor: Walter J. Kenney, Clinton, Tenn.

[73] Assignee: The United States of America as represented by the Department of Energy, Washington, D.C.

[21] Appl. No.: 262,832

[22] Filed: May 12, 1981

[51] Int. Cl.[3] ..... H01B 5/02; H01B 12/00

[52] U.S. Cl. ..... 174/126 S; 29/599; 156/50; 174/15 S; 174/117 FF; 174/128 S; 174/129 R; 174/133 R; 335/216

[58] Field of Search ..... 174/15 S, 15 C, 117 FF, 174/126 S, 128 S, 129 R, 129 B, 133 R, 133 B; 29/599, 825; 156/47, 50; 335/216; 428/544

[56] References Cited

U.S. PATENT DOCUMENTS

| | | | |
|---|---|---|---|
| 3,427,391 | 2/1969 | Bernert et al. | 335/216 |
| 3,432,783 | 3/1969 | Britton et al. | 335/216 |
| 3,443,021 | 5/1969 | Schrader | 335/216 |
| 3,470,508 | 9/1969 | Donadieu et al. | 335/216 |
| 3,550,050 | 12/1970 | Albrecht | 335/216 |
| 3,720,777 | 3/1973 | Sampson | 335/216 |
| 3,754,095 | 8/1973 | Aupoix et al. | 335/216 |
| 3,763,552 | 10/1973 | Brown et al. | 335/216 |
| 3,913,044 | 10/1975 | Albrecht et al. | 335/216 |
| 4,101,731 | 7/1978 | Marancik | 335/216 |

FOREIGN PATENT DOCUMENTS

| | | | |
|---|---|---|---|
| 1947266 | 10/1971 | Fed. Rep. of Germany | 335/216 |
| 46-696 | 9/1971 | Japan | 174/126 S |
| 54-148282 | 11/1979 | Japan | 335/216 |
| 55-52202 | 4/1980 | Japan | 335/216 |
| 6710756 | 2/1968 | Netherlands | 335/216 |

OTHER PUBLICATIONS

Laurence, J. C. et al., *Performance Tests of 51-cm-BORE Superconductive Magnets for a Magnetic-Mirror Apparatus,* Advances in Cryogenic Engineering, vol. 15, Proceedings of the 1969 Cryogenic Engineering Conference, Los Angeles, Calif., USA, Jun. 16-18, 1969, pp. 178-183.

Fietz, W. A. *Conductors for Tokamak Toroidal Field Coils,* Proc. 7th Symp. on Eng. Prob. of Fusion Research, vol. II, Knoxville, Tn., pp. 1278-1281, Oct. 25-28, 1977.

Cornish, D. N., *Superconductivity and Cryogenics for Mirror Fusion,* UCRL 83916, Lawrence Livermore National Lab., May 19, 1980.

*Primary Examiner*—A. T. Grimley
*Assistant Examiner*—Morris H. Nimmo
*Attorney, Agent, or Firm*—David E. Breeden; Stephen D. Hamel; Richard G. Besha

[57] ABSTRACT

A conductor and method of making the conductor are provided for use in winding electrical coils which are cooled by a fluid communicating with the conductor. The conductor is cold worked through twisting and reshaping steps to form a generally rectangular cross section conductor having a plurality of helical cooling grooves extending axially of the conductor. The conductor configuration makes it suitable for a wide variety of winding applications and permits the use of simple strip insulation between turns and perforated sheet insulation between layers of the winding.

4 Claims, 4 Drawing Figures

CONDUCTOR FOR A FLUID-COOLED WINDING

BACKGROUND OF THE INVENTION

This invention is a result of a contract with the United States Deparment of Energy.

This invention relates generally to conductors for electrical windings and more particularly, to a conductor for an electrical winding which is cooled by a fluid communicating with the conductor.

In the art of winding electromagnets, especially large superconducting magnet coils, cooled by immersion of liquid helium in which the temperature is controlled by a liquid medium communicating directly with the conductor, various conductor designs have been proposed which are of relatively complex configuration. This complexity is due to the conflicting requirements that the magnet be mechanically rigid when wound and yet possess ample space between turns for circulation of the fluid coolant.

In order to meet the coil mechanical rigidity requirements while simplifying the winding operation, conductors having a rectangular cross section are generally used. Thus, provisions must be made to allow the cooling fluid to freely penetrate the winding and communicate directly with the conductor for proper heat transfer and circulation of the coolant. One complicated design includes a copper cladding in which longitudinal and transverse cooling channels are milled prior to wrapping the copper clad about a composite superconductor. In addition to the cladding manufacturing complications, the clad must be soft soldered or otherwise fused to the superconductor composite to provide sufficient heat transfer.

In other coil designs an insulating material strip is helically wrapped about the rectangular conductor to additionally provide coolant flow spacing. This process requires extreme care to ensure that the insulating strip is properly advanced about the conductor at the correct pitch to maintain turn-to-turn insulation.

Thus, there is a need for an improved conductor configuration and method for making such conductors to simplify the structure and winding of electromagnets which are cooled by direct cooling fluid communication with the conductor.

SUMMARY OF THE INVENTION

In view of the above need, it is an object of this invention to provide a simple method of making a rectangular cross section conductor for use in fluid-cooled electrical windings.

Another object of this invention is to provide a conductor of rectangular cross section for use in fluid-cooled windings which requires only the simplest strip and perforated sheet insulation between windings.

Yet another object of this invention is to provide a simplified rectangular cross section superconductor for use in liquid helium-cooled electromagnet coil applications.

Other objects and many of the attendant advantages of the present invention will be obvious to those skilled in the art from the following detailed description of the preferred embodiments of the invention.

In summary, the invention pertains to an electrical conductor for an electrical winding whose temperature is controlled by a fluid communicating with the conductor. A generally rectangular cross-section conducting member is provided with a plurality of helical grooves formed in the periphery of the member by twisting an elongated, rectangular cross-section current conducting material about its longitudinal axis. The previously twisted conducting material is subsequently reshaped into a rectangular cross section.

The reshaped conductor maintains the helical grooves for free cooling fluid communication directly with the conductor while in a winding with simple strip insulation or perforated sheets between turns or layers of turns of the winding.

DETAILED DESCRIPTION

The invention will be described as applicable to the manufacturing of a composite superconductor wire for use in winding large electromagnet coils of the pool-boiling type in which the coil is cryogenically cooled by immersion in liquid helium, for example. It will be obvious to those skilled in the art that conductors formed solely of normally conducting materials, such as copper, aluminum, etc., which are used in fluid-cooled motors, generators, transformers and the like may be made in the same manner. Normally conducting materials may also refer to oxygen-free high conductivity copper or other matrix materials used in composite superconductors.

For the purposes of the present invention, the superconducting material may refer to various well-known materials, such as ductile alloys of niobium, titanium and the like, or brittle intermetallic compounds, such as $Nb_3Sn$ and the like. With ductile superconductors, strands are formed by fabricating filaments of the superconducting material in a normally conducting material matrix, such as copper, using conventional extrusion and wire drawing practice. The strands within the matrix are disposed in a twisted arrangement to cancel out superconducting eddy currents. In the present invention this twisting process for the strands may be carried out in the twisting step for forming the helical coolant grooves about the conductor as will be described hereinbelow. Thus, the strands may be originally placed in the copper matrix aligned with the longitudinal axis of the conductor, thereby further simplifying and reducing the cost of the manufacturing process.

In the case of brittle filament-type superconductors, the cabling, twisting and shaping steps according to the present invention are performed before the conductor is heat-treated in accordance with conventional practice to form the intermetallic compound filaments in the final configuration.

Figure 1:
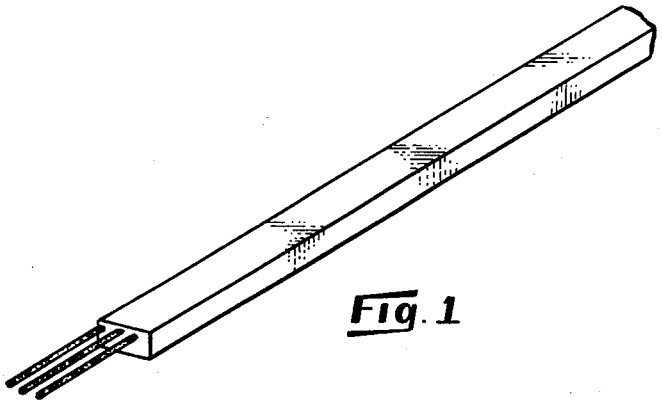
FIG. 1 depicts a segment of a rectangular cross section composite superconductor used in this invention.

Thus, it will be appreciated that the invention is applicable to a broad spectrum of conductors for various applications. Circular cross section conductors may be worked into the desired rectangular cross section by first passing the round conductor through conventional Turk's head and dies to produce the desired rectangular cross section, as shown in FIG. 1.

Figure 2:
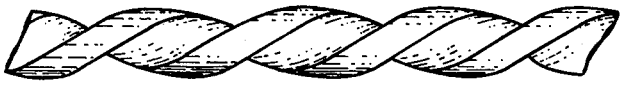
FIG. 2 depicts the twisted rectangular cross section wire of FIG. 1 wherein helical grooves are formed in the wire.

The rectangular cross section wire is then twisted along its longitudinal axis to obtain a desired twist pitch as shown in FIG. 2. This may be accomplished by rotating a take-up spool perpendicular to its axis while passing the conductor through a rectangular die. A desired strand twist pitch will determine the speed of rotation of the take-up spool. Viewed on end, the conductor at this stage appears circular in cross section with the four corners of the twisted conductor appearing as helical ridges along the conductor length.

Once the conductor has been twisted, it is again passed through a Turk's head roller to reshape the conductor into an overall rectangular shape. The conductor will pass through the roller with little tendency to twist provided the rollers are large enough to span three or four convolutions of the twisted conductor.

Depending on the winding application in which the conductor is to be used, the reshaping step may require more than one pass through the Turk's head rollers to provide a more oblong cross section. If the original cross section is oblong, the twisting operation and subsequent reshaping will provide essentially two predominant helical grooves in the final conductor. A starting square cross section will produce four essentially equal depth grooves in the conductor.

EXAMPLE

Figure 3:
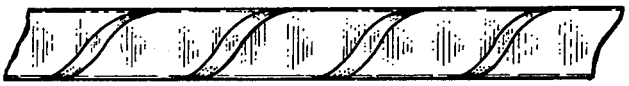
FIG. 3 depicts the wire of FIG. 2 which has been reshaped to a generally rectangular cross section to be used in a winding.

A superconductor consisting of NbTi strands in a copper matrix was drawn into a rectangular conductor approximately 0.3 cm by 0.5 cm. This conductor was twisted to produce a twist pitch of one turn/cm and then reshaped into a square cross section about 0.4 cm on a side. The result is as shown in FIG. 3 where its overall rectangular shape and helical grooves are shown.

Figure 4:
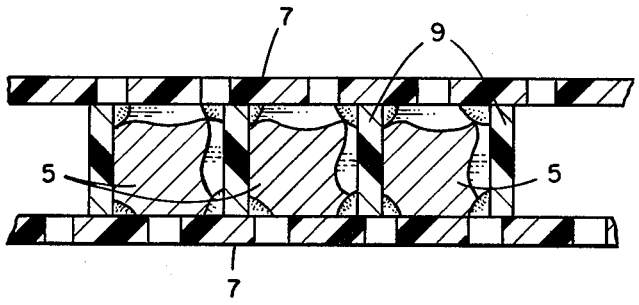
FIG. 4 illustrates a winding using the wire of FIG. 3.

Referring now to FIG. 4, there is shown a segment of a layer winding incorporating a conductor shaped according to the present invention. A sheet of perforated insulation 7 may be placed between the layers of windings and a strip of insulation 9 (either perforated or solid) may be wound between turns to provide the turn-to-turn insulation. A commercially available epoxy-fiberglass composite insulation may be used. It will be apparent that the completed magnet coil provides a very compact structure to aid overall rigidity while retaining excellent coolant flow channels for maximized fluid communication with the conductor.

For large-conductor turn applications, several conductors may be soldered or bundled together to achieve a desired conductor size and shape. The same sheet and strip insulation is all that is required for adequate helium circulation in liquid helium pool-boiling conductors for large superconducting coil applications.

What is claimed is:

1. An electrical conductor for an electrical winding whose temperature is controlled by a fluid communicating with said conductor, comprising:

a generally rectangular cross section superconducting member having a plurality of helical grooves formed in the periphery of said member by twisting an elongated, rectangular cross section, composite superconductor about its longitudinal axis and subsequently reshaping the previously twisted superconductor into said generally rectangular cross section.

2. The conductor as set forth in claim 1 wherein said composite superconductor wire comprises a matrix of normally conducting material containing a plurality of longitudinally extending strands of superconducting material.

3. The conductor as set forth in claim 2 wherein said normally conducting material is copper.

4. The conductor as set forth in claim 1 wherein said elongated rectangular cross section composite superconductor comprises an oblong cross section superconductor which yields essentially two similar helical grooves in said conducting member.

* * * * *